US011046471B2

(12) United States Patent
Peccetti

(10) Patent No.: US 11,046,471 B2
(45) Date of Patent: Jun. 29, 2021

(54) CUTTING UNIT FOR A PACKAGING MACHINE IN EXTENDABLE FILM

(71) Applicant: Colines S.p.A., Novara (IT)

(72) Inventor: Francesco Peccetti, Sizzano (IT)

( * ) Notice: Subject to any disclaimer, the term of this patent is extended or adjusted under 35 U.S.C. 154(b) by 126 days.

(21) Appl. No.: 16/494,304

(22) PCT Filed: Mar. 22, 2018

(86) PCT No.: PCT/EP2018/057269
§ 371 (c)(1),
(2) Date: Sep. 15, 2019

(87) PCT Pub. No.: WO2018/177872
PCT Pub. Date: Oct. 4, 2018

(65) Prior Publication Data

US 2021/0114760 A1 Apr. 22, 2021

(30) Foreign Application Priority Data

Mar. 30, 2017 (IT) ..... 102017000035001

(51) Int. Cl.
*B65B 61/10* (2006.01)
*B65B 11/00* (2006.01)
(Continued)

(52) U.S. Cl.
CPC ..... *B65B 61/10* (2013.01); *B26D 1/095* (2013.01); *B26F 3/12* (2013.01); *B65B 11/008* (2013.01);
(Continued)

(58) Field of Classification Search
CPC ..... B65B 11/008; B65B 11/58; B65B 21/245; B65B 61/06; B65B 61/10; B65B 2220/22; B26D 1/095; B26F 3/12
(Continued)

(56) References Cited

U.S. PATENT DOCUMENTS 3,513,620 A * 5/1970 Billingsley et al. ..... B65B 9/06 53/48.2
3,758,366 A * 9/1973 Ballestrazzi et al. ... B65B 61/10 53/553
3,782,070 A * 1/1974 Erlandson ..... B65B 61/10 53/557
(Continued)

FOREIGN PATENT DOCUMENTS

EP 0197574 A1 10/1986
WO 9009316 A1 8/1990
(Continued)

*Primary Examiner* — Stephen F. Gerrity
(74) *Attorney, Agent, or Firm* — Themis Law

(57) ABSTRACT

A cutting unit in a packaging machine for separating a series of finished packages containing a predetermined number of products from a continuous packaging or bundle advancing on a conveyor, comprising a frame, which supports a pair of side cutting blades and a pair of upper cutting and lower cutting blades arranged facing four sides of the continuous bundle, wherein the two pairs of blades can be alternately moved forward and backward between a rest position separated from the continuous bundle, and an engagement position on the continuous bundle containing groups of the products arranged on two flanked rows and wrapped in a film of extendable plastic material, each pair of blades being driven in an alternating forward and backward movement for engagement with and disengagement from the continuous bundle by a double crank actuated by a single motor.

10 Claims, 7 Drawing Sheets

(51) Int. Cl.

| | |
|---|---|
| ***B65B 21/24*** | (2006.01) |
| ***B65B 11/58*** | (2006.01) |
| ***B65B 61/06*** | (2006.01) |
| ***B26D 1/09*** | (2006.01) |
| ***B26F 3/12*** | (2006.01) |

(52) U.S. Cl.
CPC ..... *B65B 11/58* (2013.01); *B65B 21/245* (2013.01); *B65B 61/06* (2013.01); *B65B 2220/22* (2013.01)

(58) Field of Classification Search
USPC ..... 53/441, 556, 465, 210, 398, 48.1–48.9, 53/397, 399, 588, 449, 176
See application file for complete search history.

(56) References Cited

U.S. PATENT DOCUMENTS

| | | | | |
|---|---|---|---|---|
| 3,942,302 | A * | 3/1976 | Bloom | B65B 51/04 53/547 |
| 4,549,388 | A * | 10/1985 | Lancaster | B65B 11/008 53/556 |
| 2008/0047232 | A1* | 2/2008 | Kovacs | B65B 25/145 53/550 |
| 2016/0272352 | A1* | 9/2016 | Read | B65B 61/06 |

FOREIGN PATENT DOCUMENTS

| | | | |
|---|---|---|---|
| WO | 2012076195 | A1 | 6/2012 |
| WO | 2015040565 | A2 | 3/2015 |
| WO | 2015067940 | A1 | 5/2015 |

* cited by examiner

CUTTING UNIT FOR A PACKAGING MACHINE IN EXTENDABLE FILM

The present invention relates to a cutting unit in a packaging machine with extendable film.

The field of application relates to the packaging of products, for example bottles, in films made of plastic material to form bundles for their storage and transportation, also by the end-user.

Currently, in this specific field of the packaging of various types of products, such as, for example, bottles, boxes of various sizes, etc., a film of heat-shrinkable plastic material is mostly used. This film is wrapped around the product or group of products and a single package is then separated by means of a rather complex cutting device. This package is then treated in a heat-shrinking oven which makes it stable, thus stably withholding the products contained therein.

This heat-shrinkable plastic material has a certain thickness and cost and furthermore requires a further additional step, with relative oven, for treating it with heat to cause its heat-shrinkage.

If, alternatively, a film of extendable plastic material is used for the packaging, spirally wrapped around the products that are moved forwards according to a horizontal direction, the cutting step is more complicated and difficult due to the characteristics of this film.

If, on the one hand, a packaging in film of extendable plastic material eliminates the need for a heat-shrinking oven and relative energy costs and allows the use of a thinner film, at present, the cutting device used is not satisfactory as it requires various steps and unsustainably slows down the final packaging.

WO 2015/040565 describes a cutting unit for a packaging machine for separating a series of finished packages containing a predetermined number of products, from a continuous bundle advancing on a conveyor.

The general objective of the present invention is to provide a cutting unit in a packaging machine of products in extendable film which is able to solve the drawbacks of the known art indicated above in an extremely simple, economical and particularly functional manner.

A further objective of the present invention is to provide a cutting unit suitable for being inserted in a packaging machine, which can eliminate slow-downs in the packaging, increasing the production of finished packages.

Another objective of the present invention is to provide a cutting unit for a packaging machine of products in extendable film which is able to reduce the costs relating to the packaging material.

The structural and functional characteristics of the present invention and its advantages with respect to the known art will appear even more evident from the following description, referring to the enclosed schematic drawings which show an embodiment example of the invention itself. In the drawings.

With reference to FIGS. 1-4, these show a cutting unit according to the present invention which can be inserted in a final portion of a packaging machine in extendable film, of products 11, such as bottles or other objects, not shown, and, for example, of the type described in Italian patent applications Nr. 102016000012911 and 102016000013038 of the same Applicant.

Figure 1:
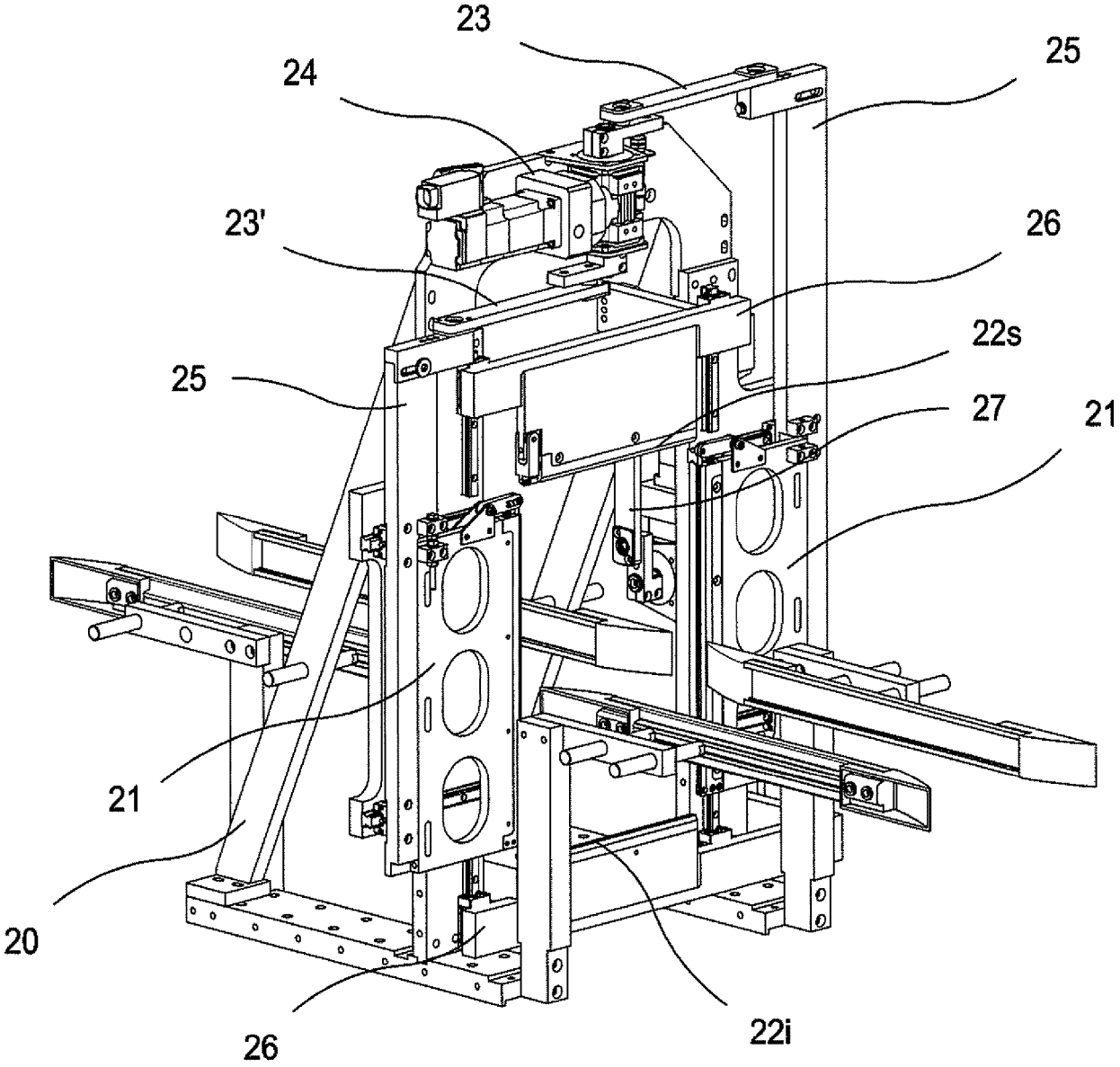
FIG. 1 is a perspective view in which a cutting unit according to the present invention is provided, suitable for being inserted in a packaging machine of products in extendable film.
Figure 2:
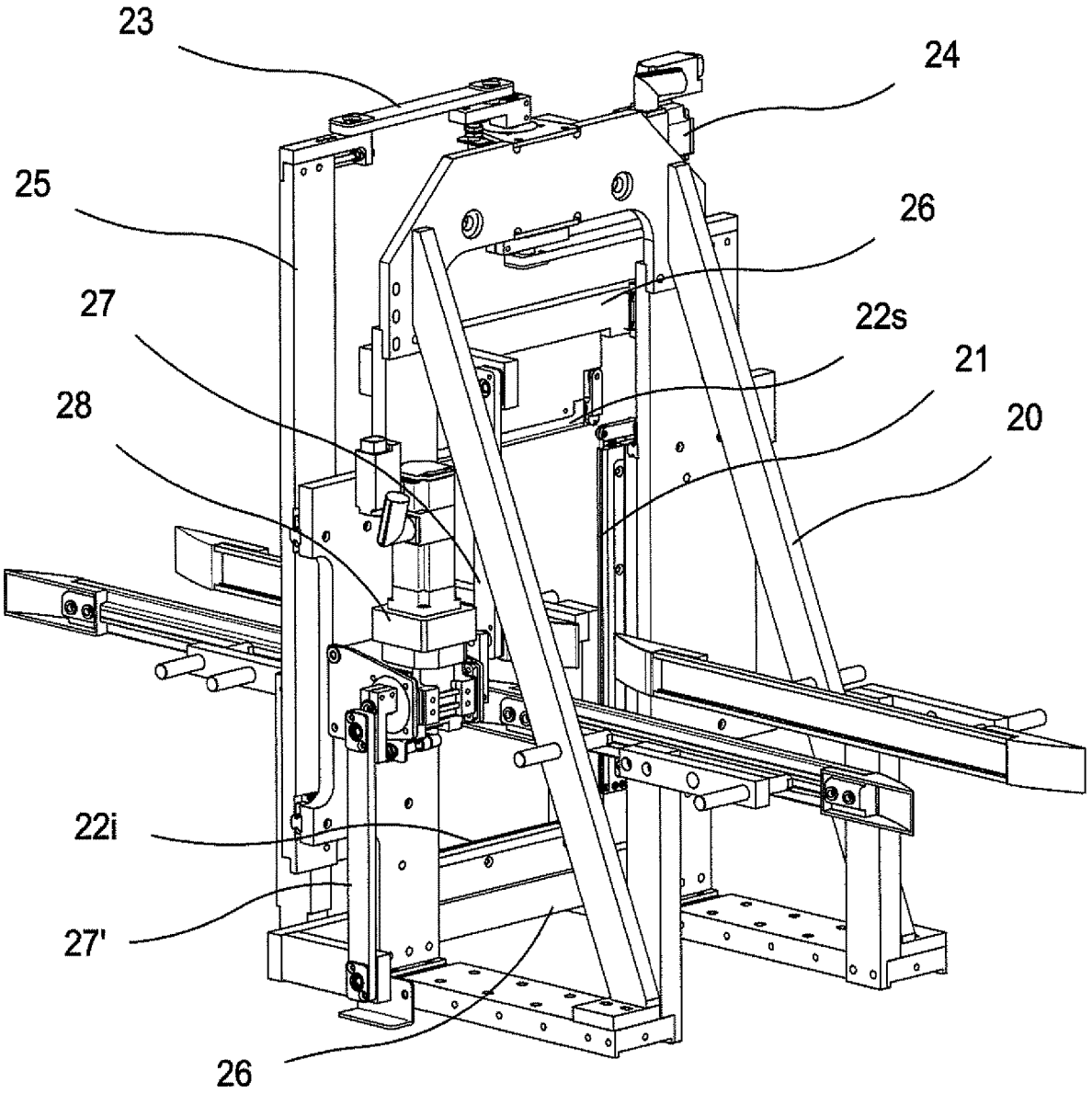
FIG. 2 is a perspective view of the unit shown in FIG. 1 as it appears from a position at 180° with respect to the previous view with the blades open in a rest position.
Figure 3:
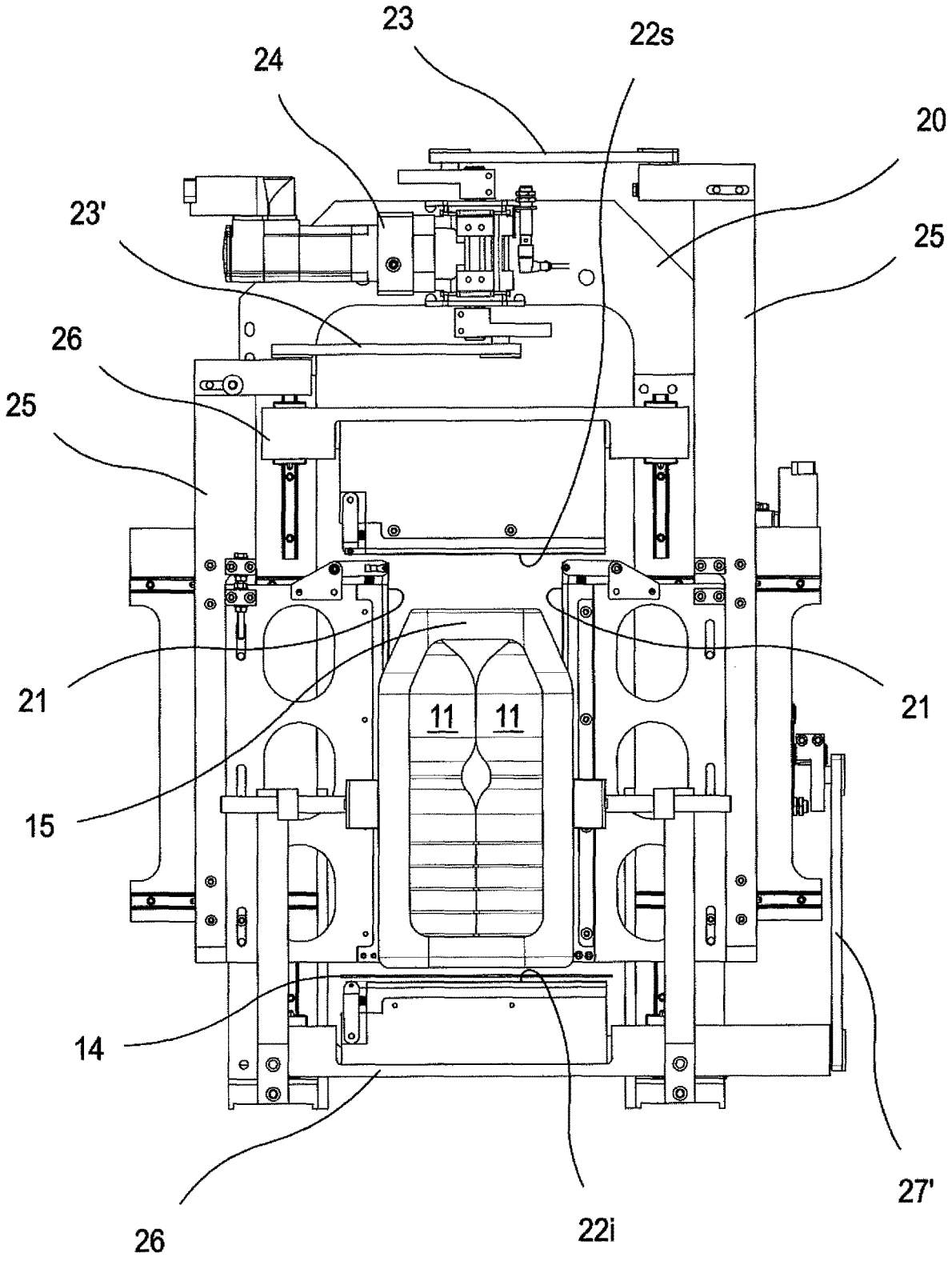
FIG. 3 is a sectional view of the cutting unit in a side cutting position of a continuous bundle of bottles.
Figure 4:
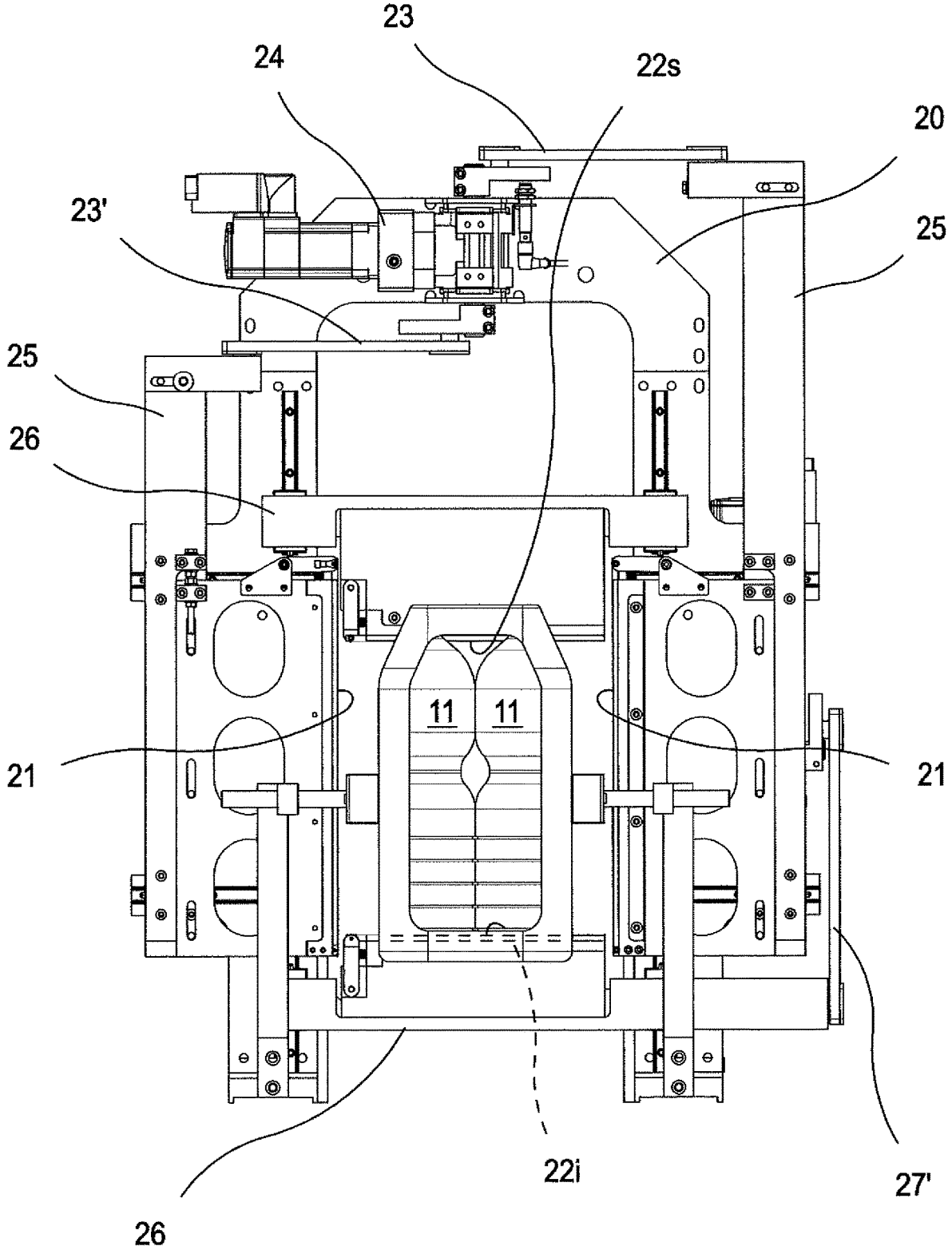
FIG. 4 is a sectional view of the cutting unit with the upper and lower blades in a cutting position of the continuous bundle of bottles.
Figure 5:
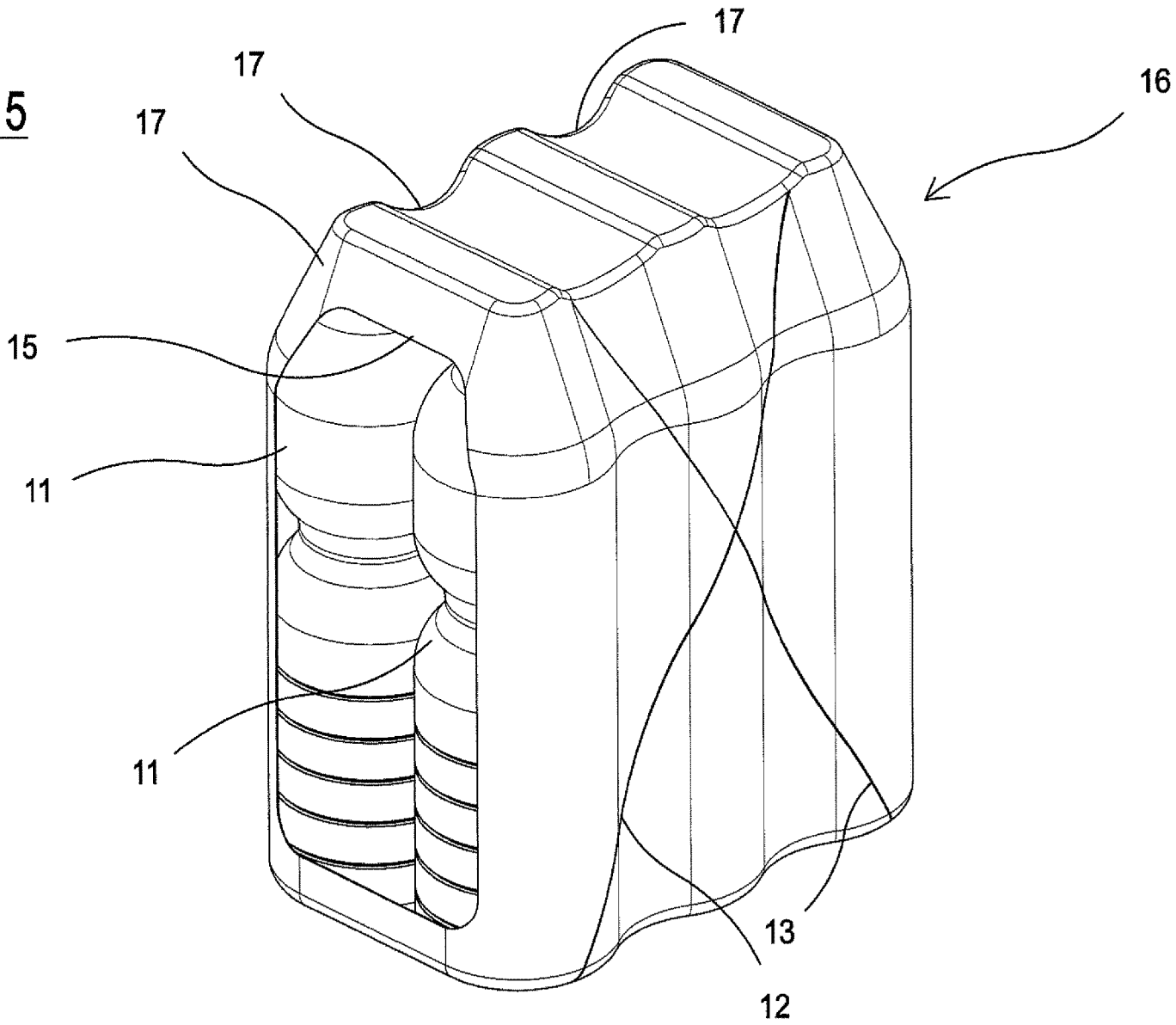
FIG. 5 is a perspective view of a package produced with the cutting unit shown in the previous figures according to the present invention.

In general, the single products, such as bottles 11, are ordered upstream of a wrapping station in which the same are arranged inside a continuous film 15 wrapped around products 11 with a single turn or crossed turns according to the directions 12, 13, indicated in FIG. 5, to form a continuous bundle. This continuous packaging or bundle therefore comprises two layers of film wrapped in opposite directions around these products 11.

In the case of bottles 11, for example, said bottles 11 are fed in flanked pairs moved forwards on a lower feeding conveyor, schematized with the line 14 until entering, thus wrapped, the cutting unit.

Said continuous bundle then passes into the unit of the present invention fed on a normal conveyor 14, for example with a belt or rollers.

It should be noted how these products 11 are, for example, contained wrapped in an extendable film in an intersection of film layers arranged so as to stabilize the package when finished.

As already mentioned, this cutting unit according to the invention separates the continuous bundle or packaging into finished groups of products 11, wrapped in film of extendable plastic material and forming a final package 16, after cutting.

A cutting unit according to the invention must intervene in a packaging machine for separating, from a continuous packaging or bundle moving forwards, a series of finished packages 16 of a predetermined number of products 11, shown in FIG. 5 as six bottles 11 flanked in pairs.

It can thus be seen how the package has side-cut areas and upper and lower horizontal-cut areas in correspondence with the cutting.

The cutting unit comprises a frame 20 that supports a pair of side cutting blades 21 and a pair of upper cutting **22*s* and lower cutting 22*i*** blades arranged facing four sides of the continuous bundle.

The four blades 21, **22*s* and 22*i* can be alternately moved forwards and backwards between a rest position separated from the continuous bundle and an engagement position on the continuous bundle containing groups of products 11, wrapped in a film of extendable plastic material 15**.

The two side cutting blades 21 are arranged vertically and are driven in an alternating forward and backward movement for engagement and disengagement from the continuous bundle by means of a double crank 23, 23'. The double crank 23, 23' is actuated by a single motor 24 which drives relative slides 25 horizontally movable with respect to the frame 20 and carrying said cutting blades 21.

The upper cutting blade **22*s* and lower cutting blade 22*i* are also carried by relative slides 26 which can be moved vertically with respect to the frame 20**.

The slides 26 can be moved vertically by means of a second double crank 27, 27' which is also actuated by a single motor 28.

The frame 20, in fact, causes a pair of slides 26 to move upwards and downwards, each slide carrying the upper cutting blade 22*s* and the lower cutting blade 22*i* respectively.

Furthermore, the frame 20 is moved forwards to "follow" the continuous bundle of bottles, advancing at the same rate, from which a single bundle must be formed. This "tracking" is effected for a length so as to allow both the side cutting blades 21 and the upper cutting blade 22*s* and lower cutting blade 22*i* to intervene on the continuous bundle and separate a finished package 16.

After separating the packaging, the cutting unit according to the invention on its frame 20 returns rapidly back to the continuous bundle to separate a new packaging 16.

Figure 6:
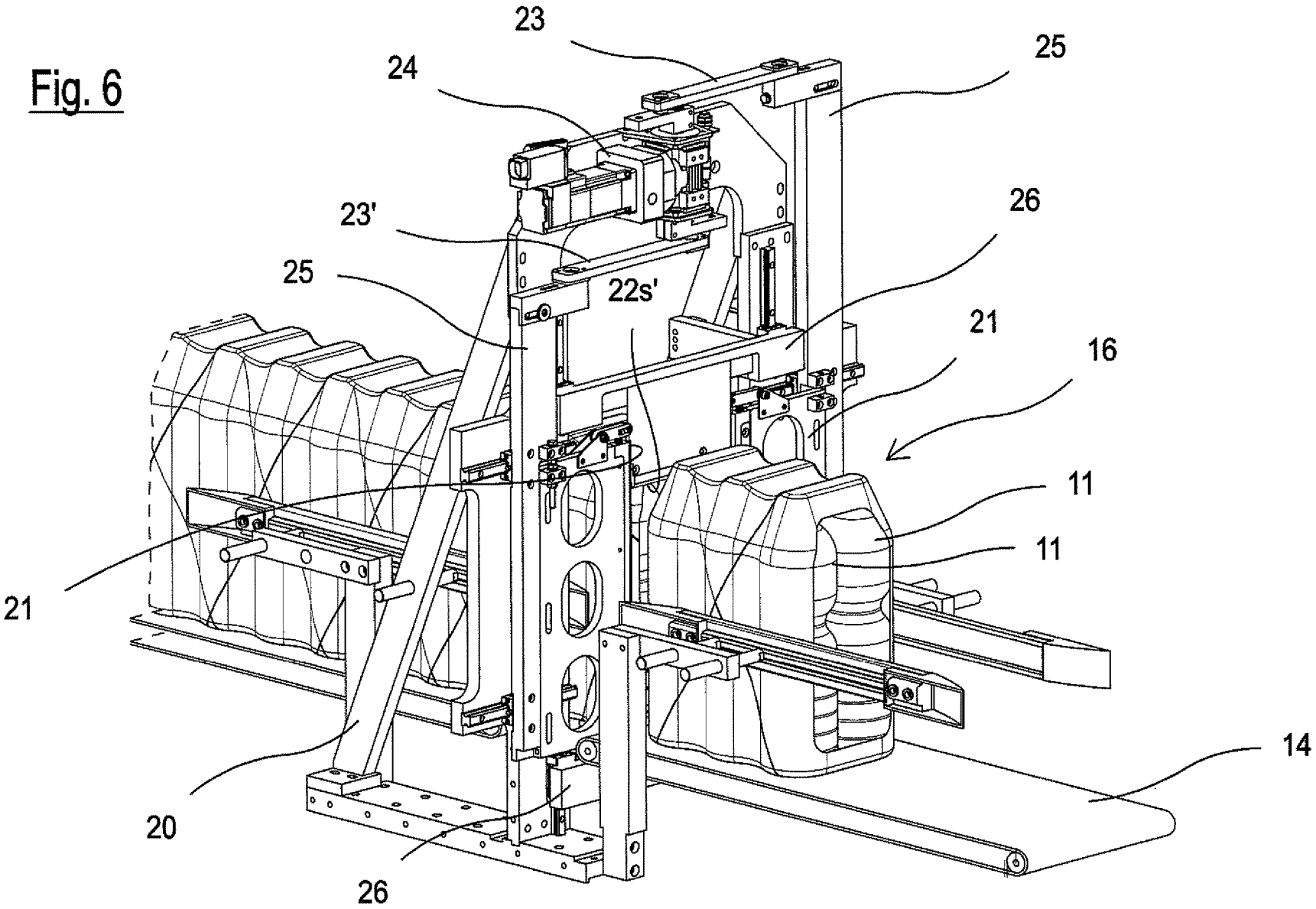
FIGS. 6 and 7 are a perspective view and a cross-section of a second embodiment of a cutting unit according to the invention.
Figure 7:
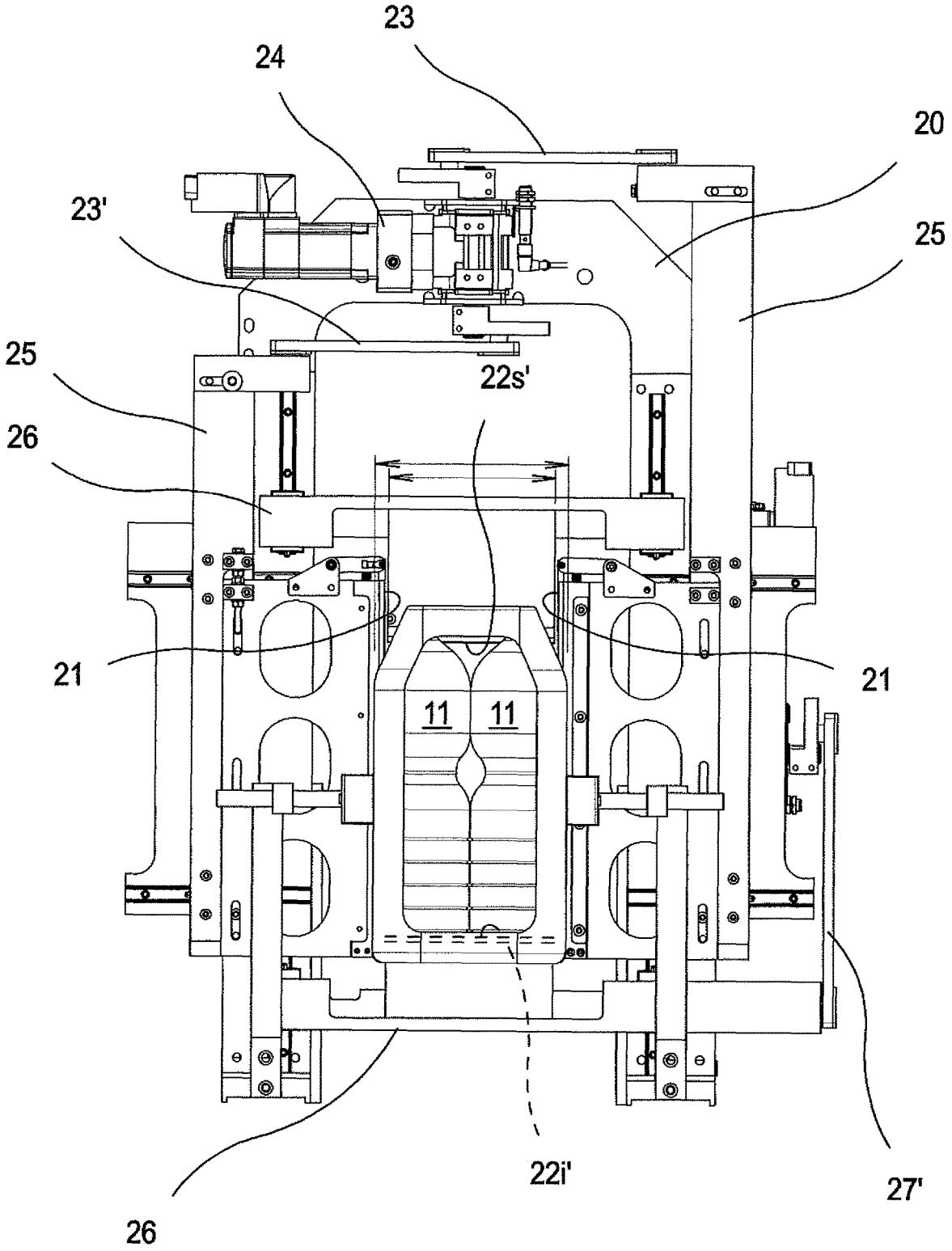

FIGS. 6 and 7 show a further example of a cutting unit according to the invention.

In this example, functionally equal elements are indicated with the same reference numbers as the previous example of FIGS. 1-4.

Also in this example, two side cutting blades 21 are provided, which are also arranged vertically.

The two cutting blades are driven in an alternating forward and backward movement for engagement and disengagement from the continuous bundle by means of the above-mentioned double crank 23, 23'. Also in this case, the double crank 23, 23' is actuated by a single motor 24 which controls the slides 25 that carry the two side cutting blades 21.

Otherwise, an upper cutting blade 22*s'* and a lower cutting blade 22*i'* are provided, carried by relative slides 26 that are vertically movable with respect to the frame 20. Said slides can also move vertically through a second double crank 27, 27' actuated by a single motor 28.

In this case, the upper cutting blade 22*s'* and the lower cutting blade 22*i'* provide an amplitude slightly less than the transversal dimension of the packaging 16 and act in a recessed area 17 between consecutive pairs of bottles 11.

This reduced dimension allows a simultaneous action between the two side cutting blades 21 and the upper cutting blade 22*s'* and lower cutting blade 22*i'*, as shown in FIGS. 6 and 7.

This is achieved by a common drive of the motor 24 and the motor 28 for actuating both of the crank mechanisms 23, 23' and 27, 27'. This simultaneous actuation causes an action of the four blades 21, 22*s'* and 22*i'* on the continuous bundle.

Also in this case, despite the reduced time of this cutting operation, the action of the cutting unit is effected while the frame 20 is moved forwards to "follow" the continuous bundle of bottles from which the single bundle is to be separated. Once the cutting has been completed, said frame 20 of the cutting unit is then brought back onto the continuous bundle ready to separate a new packaging 16.

In a further embodiment, the cutting unit comprises cutting elements arranged on the frame in the form of hot wires instead of blades. These hot wires are used both as side, upper and lower cutting elements. These cutting elements can also be moved alternately between a rest position separated from the continuous bundle and an engagement position on the bundle.

According to the invention, therefore, this particular cutting unit acts on the continuous packaging of plastic material wrapped around the bottles 11 to make a cut on four sections of the packaging, two vertical and two horizontal, which thus form the perimeter of the transverse cutting of the package as shown in FIG. 5.

The functioning of a cutting unit according to the invention in a packaging machine in extendable film of products fed in continuous is as follows.

Once a continuous packaging or bundle containing products, such as pairs of bottles, has been produced in the packaging machine, said packaging is sent to the cutting unit.

This continuous packaging or bundle of pairs of bottles 11, produced for example with crossed layers of extendable film but not exclusively in this way, passes onto the lower conveyor 14. The conveyor 14 supports and accompanies the continuous packaging or bundle in the cutting unit during the complete cutting phase.

The whole cutting unit carried by the frame 20 and carrying the side cutting blades 27 and upper cutting blade 22*s* and lower cutting blade 22*i*, moves according to the same advance rate as the continuous bundle containing the bottles 11.

In a cutting unit according to the invention, the cutting is effected during the advancement phase of the bundle and frame of the cutting unit at the same rate and is terminated when the frame or cutting unit is moved back when the packaging is finished.

It has previously been seen how, both in the first example and in the second example, the cutting unit interacts with the layers of film of the continuous bundle on horizontal sections and on vertical sections of the continuous packaging or bundle, causing the separation of the packaging 16.

The cutting times with respect to known devices in which vertically cut sections are produced, followed by horizontally cut sections or viceversa in two consecutive steps both at the top of the packaging and at the end of the packaging, are halved.

Furthermore, a direct action in a single advancement phase of the cutting unit ensures perfect alignment between horizontal cuts and vertical cuts.

A correct cutting of the continuous bundle of finished packages 16 of the required size, is thus obtained.

As in the known systems, this type of cut defined as "perimetric" transverse to the packaging, involves short strokes of the blades in extremely reduced times.

The objective mentioned in the preamble of the description has therefore been advantageously achieved. A cutting unit is provided with particularly reduced intervention times.

Furthermore, using extendable plastic material, no heat-shrinking is necessary, with a considerable energy saving.

More than one cutting unit within a packaging machine can also be provided, for example, with an increase in the hourly productivity.

The forms of the structure for producing a cutting unit of the present invention, as also the materials and assembly modes, can naturally differ from those shown as a purely non-limiting example in the drawings.

The protection scope of the present invention is defined by the enclosed claims.

The invention claimed is:

1. A cutting unit for a packaging machine for separating a series of finished packages (16) containing a predetermined number of products (11), from a continuous bundle advancing on a conveyor (14), comprising:

a frame (20); and two pairs of cutting elements, comprising a pair of side cutting elements (21) supported by the frame and a pair of upper cutting elements (22*s*,22*s'*) and lower cutting elements (22*i*,22*i'*) arranged facing four sides of the continuous bundle, wherein said two pairs of cutting elements (21; 22*s*, 22*s*', 22*i*, 22*i*') can be alternately moved forwards and backwards between a rest position separated from said continuous bundle and an engagement position on the continuous bundle containing groups of the products (11), arranged on two adjacent rows and wrapped in a film of extensible plastic material (15), and wherein each pair of the cutting elements (21; 22*s*, 22*s*', 22*i*, 22*i*') is driven in an alternating forward and backward movement for engagement with, and disengagement from, the continuous bundle by a double crank (23, 23'; 27, 27') actuated by a single motor (24; 28).

2. The cutting unit according to claim 1, wherein said pair of side cutting elements comprise blades (21) and said pair of upper and lower cutting elements comprise blades (22*i*, 22*i*').

3. The cutting unit according to claim 2, wherein each blade of said pair of side cutting elements (21) is positioned on a slide (25) horizontally movable with respect to said frame (20).

4. The cutting unit according to claim 2, wherein each blade of said pair of upper cutting and lower cutting elements (22*i*, 22*i*') is carried by a slide (26) vertically movable with respect to the frame (20).

5. The cutting unit according to claim 1, wherein said frame (20) is adapted to move forward from a starting position and advance at a same rate as the continuous bundle during cutting of the film to produce a package (16) and to return back to the starting position so as to separate a new package (16).

6. The cutting unit according to claim 1, wherein said upper (22*s*') and lower (22*i*') cutting elements are arranged to be spaced at an amplitude down to less than a transversal dimension of a package (16).

7. The cutting unit according to claim 6, wherein said upper (22*s*') and lower (22*i*') cutting elements operate in a recessed area (17) between consecutive pairs of the products (11).

8. The cutting unit according to claim 1, wherein said products are bottles (11).

9. The cutting unit according to claim 1, wherein said continuous bundle comprises two layers of the film wound in opposite directions around said products (11).

10. The cutting unit according to claim 1, wherein said pair of side cutting elements, and said upper and lower cutting elements are hot wires.

* * * * *